US005848586A

United States Patent [19]

Garms

[11] Patent Number: 5,848,586

[45] Date of Patent: Dec. 15, 1998

[54] FIRE SAFETY COLLAR FOR GAS WATER HEATERS

[76] Inventor: Richard C. Garms, 1000 S. McCall Rd., Englewood, Fla. 34223

[21] Appl. No.: 778,973

[22] Filed: Jan. 6, 1997

[51] Int. Cl.[6] ..... F24H 1/00

[52] U.S. Cl. ..... 126/361; 126/344; 126/350 R; 126/389; 126/85 B; 122/13.1; 122/14; 122/11; 122/17; 122/18; 122/19; 122/16

[58] Field of Search ..... 126/361, 344, 126/350 R, 389, 85 B; 122/13.1, 14, 11, 17, 18, 19, 16

[56] References Cited

U.S. PATENT DOCUMENTS

| | | | |
|---|---|---|---|
| 4,915,091 | 4/1990 | Varney | 126/65 |
| 5,062,790 | 11/1991 | Loberger | 431/114 |
| 5,199,385 | 4/1993 | Doss . | |
| 5,253,635 | 10/1993 | Overall | 126/85 B |
| 5,345,224 | 9/1994 | Brown | 340/605 |
| 5,549,470 | 8/1996 | Henderson | 431/302 |
| 5,551,414 | 9/1996 | Quick | 126/85 B |

*Primary Examiner*—Larry Jones
*Attorney, Agent, or Firm*—John V. Stewart

[57] ABSTRACT

An air inlet system for gas water heaters that prevents or delays the ignition of fumes from flammable liquids accidentally spilled on the floor. The air inlet is above the quickly combustible fumes from spilled liquids, allowing time for personal escape or other response. Two concentric air baffles are placed around the tank of the water heater, and are sealed against the floor. They are spaced from each other and from the tank, forming two concentric air chambers around the tank which are open at the top. The inner air baffle is taller than the outer baffle, and has holes or gaps around its lower end for air passage. When the burner is operating, combustion inlet air enters the top of the outer air chamber, travels downward, passes through the holes in the inner baffle, and under the tank to the burner. When the burner is off, the inner air chamber is warmed by the tank, causing convection between the outer and inner chambers that constantly refreshes the air in the chambers, preventing inefficient burning, CO production, or flame-out of the pilot or burner from oxygen depletion.

6 Claims, 3 Drawing Sheets

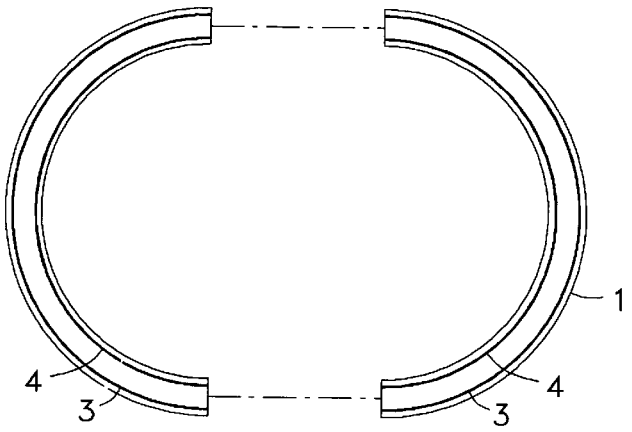
FIG 5
FIG 6
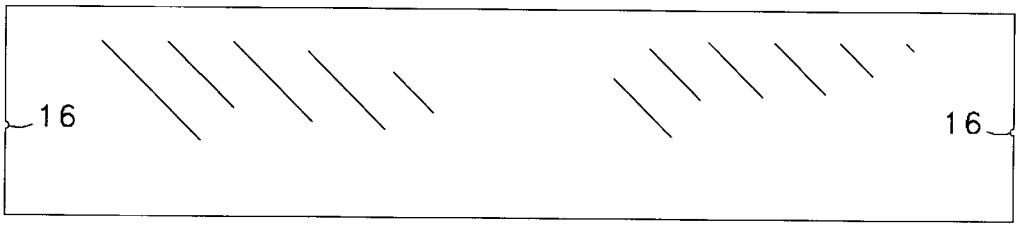
FIG 7
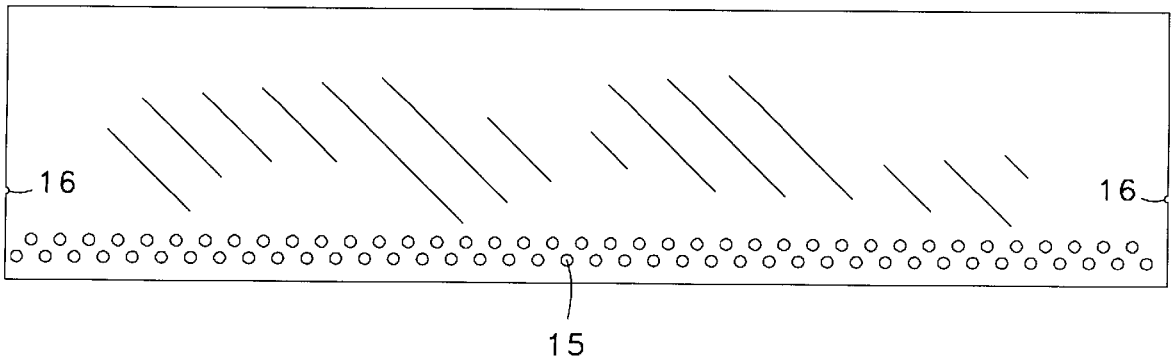

FIRE SAFETY COLLAR FOR GAS WATER HEATERS

BACKGROUND

1. Field

This invention relates to fire prevention devices for gas appliances, especially for gas water heaters.

2. Prior Art

Conventional gas water heaters draw inlet air to a burner near the floor under the water tank. If a flammable liquid is spilled on the floor near the heater, it can be easily ignited by the burner or its pilot. The time between the spill and ignition can be very short for highly flammable liquids such as gasoline, kerosene, certain cleaners, etc., which may be stored, carried, or temporarily placed near such water heaters. Fast ignition leaves little or no time for recognition of the situation and a response, such as turning off the gas valve or personal escape.

OBJECTIVES AND SUMMARY

Objectives

An object of this invention is the prevention of fires caused by accidental spillage of a flammable liquid on the floor near a gas water heater. A second object is universal retrofit capability of this safety collar to installed water heaters, requiring only the skill level of an average handyperson. A third object is maintaining the dependability and efficiency of the heater. A fourth object is low cost.

Summary

The instant invention is an air inlet system for gas water heaters that prevents or delays the ignition of fumes from flammable liquids accidentally spilled on the floor. The air inlet is above the quickly combustible fumes from spilled liquids, allowing time for personal escape or other response. Two concentric air baffles are placed around the tank of the water heater, and are sealed against the floor. They are spaced from each other and from the tank, forming two concentric air chambers around the tank which are open at the top. The inner air baffle is taller than the outer baffle, and has holes or gaps around its lower end for air passage. When the burner is operating, combustion inlet air enters the top of the outer air chamber, travels downward, passes through the holes in the inner baffle, and under the tank to the burner. When the burner is off, the inner air chamber is warmed by the tank, causing convection between the outer and inner chambers that constantly refreshes the air in the chambers, preventing inefficient burning, CO production, or flame-out of the pilot or burner from oxygen depletion.

DRAWINGS

Figure 1:
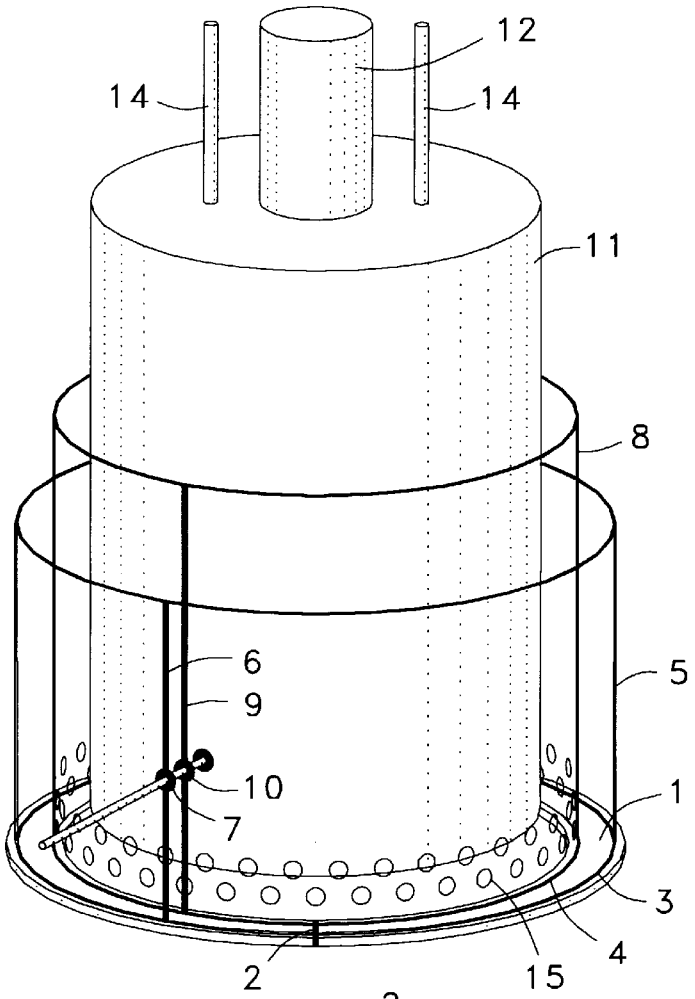

FIG. 1 Perspective view of water heater with safety collar

Figure 2:
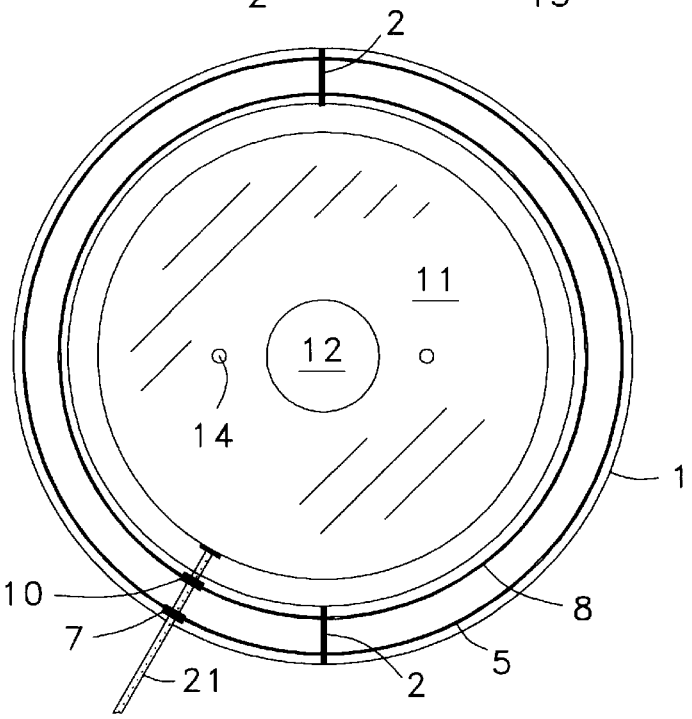

FIG. 2 Top view of water heater with safety collar

Figure 3:
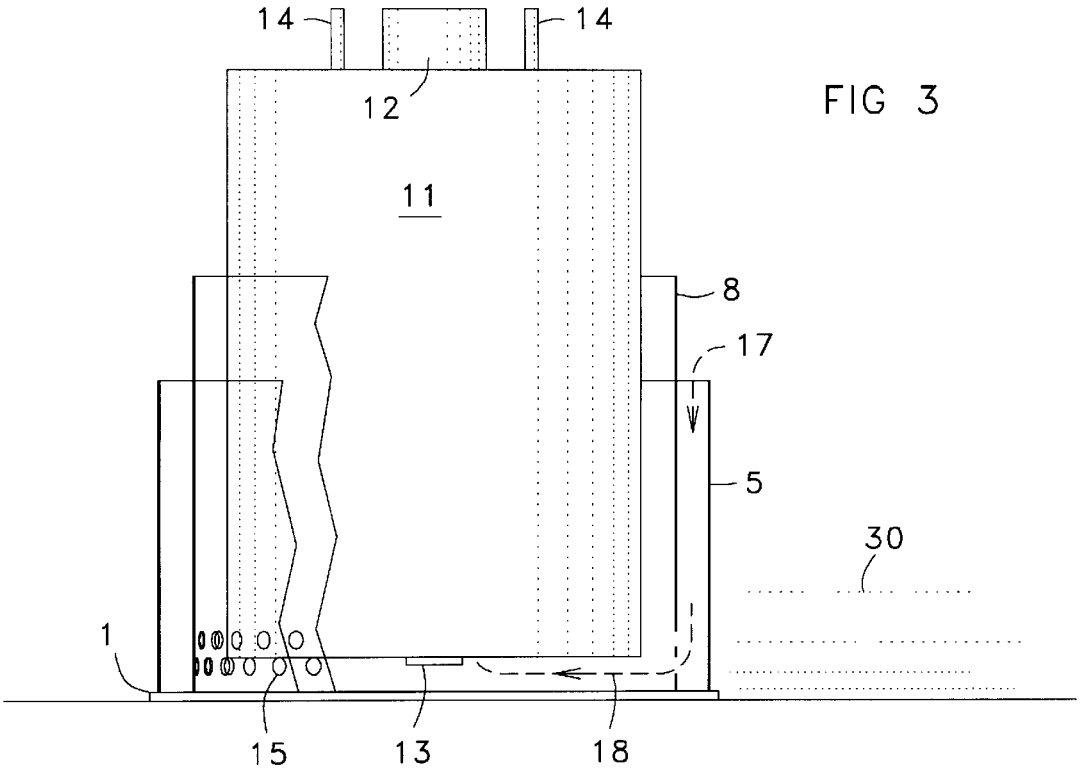
Figure 4:
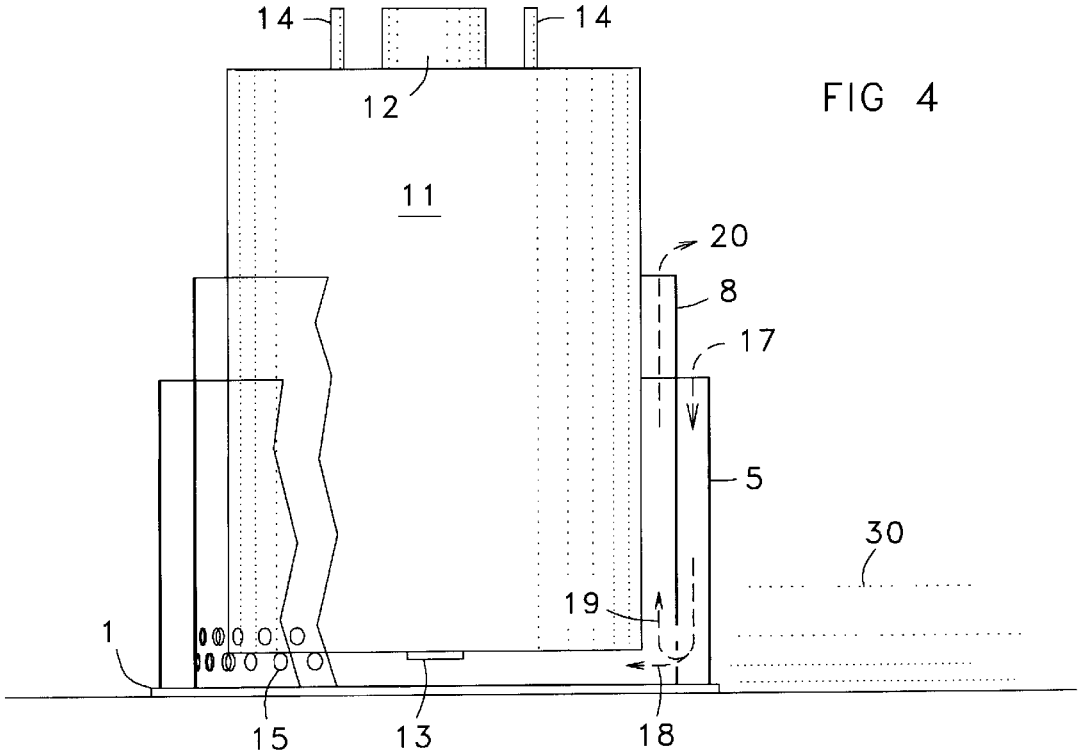

FIG. 3 Front view of water heater, with safety collar partially in section, showing inlet air circulating to burner FIG. 4 Front view as in FIG. 3, with inlet air circulation when only pilot light is burning FIG. 5 Top view of the two halves of collar base FIG. 6 Front view of outer baffle sheet unrolled FIG. 7 Front view of inner baffle sheet unrolled

REFERENCE NUMERALS

1. Collar base

2. Sealed seam of two halves of collar base

3. Groove in collar base for outer baffle

4. Groove in collar base for inner baffle

5. Outer baffle

6. Sealed seam of joined ends of outer baffle

7. Gas line gasket in outer baffle

8. Inner baffle

9. Sealed seam of joined ends of inner baffle

10. Gas line gasket in inner baffle

11. Gas water heater tank

12. Combustion exhaust flue

13. Gas burner

14. Water lines

15. Holes at bottom of inner baffle for air circulation

16. Cut-outs in baffles for gas line

17. Air inlet into outer air chamber

18. Air circulating under tank to burner

19. Air rising in inner air chamber due to warmth from tank

20. Air escaping from top end of inner air chamber

21. Gas line

30. Potentially combustible fumes from spilled liquid on floor

DESCRIPTION

FIG. 3 shows a conventional gas water heater tank (11) mounted on a floor on short legs (not shown) with clearance under the tank for air circulation to the burner (13). Gasses heated by the burner rise in a flue which passes through a heat exchanger in the tank transferring combustion heat to water in the tank. The gasses then flow upward in the flue (12) above the tank and are exhausted outside the building. This circulation draws inlet air toward the burner from air near the floor around the tank. All of the above-described elements and functions are conventional.

According to this invention, concentric cylindrical baffles (5 and 8) surround the bottom of the tank. The outer baffle is sealed against the floor, and both baffles are open at the top. The inner baffle is taller than the outer one. Clearance between the inner and outer baffles creates an air duct that allows air to enter at the top of the outer baffle (17) and flow between them. The inner baffle has holes (15) or gaps around its lower edge, which allow inlet air to flow underneath the tank (18) to the burner. When the burner is operating (FIG. 3), this circulation pattern aerates it.

When only the pilot is burning (FIG. 4), there is inadequate heat to maintain a definite circulation of air in the inlet duct. To prevent air stagnation and depletion of oxygen in the inlet duct, the inner baffle is spaced from the tank, creating second air duct, which surrounds the tank. Warmth escaping from the sides of the tank heats the air in this space, causing it to rise. It flows out the top of the inner baffle (20), continuously drawing fresh air into the inlet duct (17). This maintains fresh inlet air for the burner, avoiding inefficient or slow start-up, flame-out of the burner, or production of Co.

The purpose of the baffling is to raise the air inlet about 18 inches or more above the floor. In case a flammable liquid is spilled near the heater, it cannot flow under the heater. Thus, its ignition will be prevented entirely, or at least delayed long enough for escape or response by the user, such as shut-off of gas to the burner and pilot.

In order to retrofit the baffles to existing heaters, a kit embodiment as shown in FIGS. 5–7 is suggested. Each baffle is provided as rectangular sheet of flexible material, such as metal or plastic. Elastic, flexible sealing strips (6 and 9) are provided with longitudinal grooves to receive the ends of the baffles, for closing them into cylindrical shells. These strips may be made of foam rubber, silicone rubber, or the like. They may each have a lateral slit to accept the gas inlet tube 21. They may be longer than the height of the baffle, so the lateral slit can be positioned vertically as needed, and the excess seal length cut at the top and bottom of each baffle. Alternately, the user can cut the slit in the seal wherever it is needed. Alternately, the baffle sheets may have semi-circular cut-outs for the gas inlet tube, as shown, and the linear seal material can be discontinuous at the cut-out. In this case, split sealing gaskets (7 and 10) of a flexible, elastic material can be provided to slip around the gas tube, and conform to the baffle material and the ends of the linear seals.

A collar base (1) is provided for sealing the baffles to the floor and maintaining their spacing. It has concentric grooves (3 and 4) for receiving the bottom edges of the baffle sheets. The collar base can be made in segments, as shown in FIG. 5, to be placed on the floor around the water tank, and joined together. Seals (2) join the ends of the segments. This seal (2) can be a flexible elastic molded material, or a caulking material such as silicone rubber sealant. The collar base must be sealed to the floor, which can be done via a soft, flexible gasket, or a silicone rubber sealant.

Alternately, the collar base can be made of a single length of flexible material, extruded or molded with linear grooves to receive the bottom edges of the baffles, and curved to match the radius of the closed baffles. This material can be passed around the bottom of the water tank, and its two ends sealed together to form a circle.

Optionally, spacers may be attached between the top edge of the outer baffle and the adjacent side of inner baffle, to enforce uniform spacing between the baffles.

Alternate forms of this invention are possible. For example the holes along the bottom edge of the inner baffle can be formed by cut-outs or undulations in the edge of the baffle sheet, of any shape, such as sinusoidal, rather than closed holes. The baffles need not be concentric with the heater or with each other. If the water heater is installed close to a wall, at that point the baffles can touch each other and the inner baffle can touch the tank. If the water heater is installed touching one or two walls, the baffles need not surround the tank, as long as two air chambers are available on at least one side of the heater, the inner chamber is adjacent the heater tank and is sealed from the outer chamber except for passages at the bottom, and the outer chamber is completely sealed all around the burner. This latter requirement can be met by sealing the outer chamber around the burner from the bottom of the tank. These modifications in the design are examples of modifications which conform to the scope and spirit of the present invention.

Preferred Embodiment

The preferred embodiment is shown in all drawing figures.

Operation of Preferred Embodiment

The collar base (1) is placed on the floor around the tank, and sealed to the floor. The ends of the collar base segments (2) are sealed together. The inner baffle sheet (8) is wrapped around the water tank, with its ends meeting at the gas tube (21). The inner sheet ends are sealed together, and the gas tube is sealed where it passes through (10). The inner sheet lower edge is placed in the inner groove (4) of the collar base. The outer baffle sheet (5) is wrapped concentrically around the water tank, with its ends meeting at the gas tube (21). The outer sheet ends are sealed together, and the gas tube is sealed where it passes through (7). The outer sheet lower edge is placed in the outer groove (3) of the collar base. If upper spacers are provided, they are attached to the upper edge of the outer baffle.

Scope

Although the present invention has been described herein with respect to a preferred embodiment hereof, it will be understood that the foregoing description is intended to be illustrative, and not restrictive. Many modifications of the present invention will occur to those skilled in the art. All such modifications which fall within the scope of the appended claims are intended to be within the scope and spirit of the present invention.

I claim:

1. A kit for reducing the fire hazard of conventional floor-mounted gas water heaters, comprising:

a first rectangular thin sheet of flexible material, having a top edge, a bottom edge, and two side edges, with air passage ways along the bottom edge;

a second rectangular thin sheet of flexible material, having a top edge, a bottom edge, and two side edges, the side edges of the second sheet being shorter than the side edges of the first sheet, and the top and bottom edges of the second sheet being longer than the top and bottom edges of the first sheet;

means for sealing the side edges of the first sheet together to form a first shell;

means for sealing the side edges of the second sheet together to form a second shell; and means for sealing the bottom edge of the second shell to the floor.

2. The kit of claim 1, wherein the means for sealing the bottom edge of the second shell to the floor comprises a segmented circular base having a top side with means for receiving the bottom edge of the second shell, and a bottom side, with means for sealing the bottom side of the base to the floor.

3. The kit of claim 2 wherein, the segmented circular base includes a first circular groove in its top side for receiving the bottom edge of the first sheet, and a second circular groove in its top side, of larger diameter than the first groove, for receiving the bottom edge of the second sheet.

4. A method for preventing the burner or pilot of a conventional floor-mounted gas water heater from igniting a flammable liquid spilled on the floor, comprising the steps of;

a) wrapping a first thin sheet of flexible material with air passage ways along its lower edge around the heater and sealing the first sheet ends together to form a shell around the heater, and spaced from it;

b) wrapping a second thin sheet of flexible material, which is shorter in height than the first sheet, around the first sheet, and sealing the second sheet ends together to form a shell around the first sheet, and spaced from it; and c) sealing the lower edge of the second sheet to the floor; whereby air can enter the space between the two sheets, from the top edge of the second sheet, and can flow downward between the sheets, then through the air passage ways in the first sheet to the burner underneath the heater, but a liquid spilled on the floor cannot flow under the second sheet to reach the burner of the heater.

5. The method of claim 4, further comprising the initial steps of placing a segmented circular base on the floor around the heater, and sealing the segments to the floor in a closed circle; wherein step a) further comprises placing the lower edge of the first sheet in a circular groove in the base; and step b) further comprises placing the lower edge of the second sheet in a second circular groove in the base and sealing it therein.

6. A method for blocking flammable liquids spilled on a floor from approaching a burner on the bottom of a conventional hot water heater having a vertical side, comprising the steps of:

a) providing a first duct from the burner to an opening in the first duct beside the water heater above the floor, the first duct in contact with the vertical side of the water heater;

b) providing a second duct in contact with the first duct, but not in contact with the water heater, from a communication point between the first and second ducts at the bottom of the vertical side of the water heater to an opening in the second duct below the level of the opening of the first duct;

whereby inlet air is convectively drawn to the burner by entering the opening in the second duct, reaching the burner through the first duct via the communication point, and when the burner is off, air can circulate convectively downward in the second duct and upward in the first duct via the communication point, driven by heat from the vertical side of the water heater to maintain fresh air in the ducts.

* * * * *